United States Patent [19]

Santilli

[11] 4,074,220

[45] Feb. 14, 1978

[54] FUSE STRUCTURE HAVING IMPROVED GRANULAR FILLER MATERIAL

[75] Inventor: James N. Santilli, Bloomington, Ind.

[73] Assignee: Westinghouse Electric Corporation, Pittsburgh, Pa.

[21] Appl. No.: 723,255

[22] Filed: Sept. 14, 1976

Related U.S. Application Data

[63] Continuation of Ser. No. 515,949, Oct. 18, 1974, abandoned.

[51] Int. Cl.[2] ..... H01H 85/18

[52] U.S. Cl. ..... 337/276; 337/280

[58] Field of Search ..... 337/276, 277, 279, 280

[56] References Cited

U.S. PATENT DOCUMENTS

| | | | |
|---|---|---|---|
| 1,157,919 | 10/1915 | Arsem | 337/280 |
| 1,959,770 | 5/1934 | Slepian | 337/280 |
| 3,227,844 | 1/1966 | Burrage et al. | 337/280 X |

OTHER PUBLICATIONS

Inorganic Chemistry, Jones, 1947, pp. 259–261.

*Primary Examiner*—George Harris
*Attorney, Agent, or Firm*—W. R. Crout

[57] ABSTRACT

A fusible device is provided, of the generally-enclosed type, having an improved granular filler material surrounding, or encompassing the one or more fuse links. Preferably, the granular filler material comprises sand and alumina trihydrate ($Al_2O_3.3H_2O$). Another filler material, which gives roughly half the improvement of the aluminum trihydrate, is aluminum monohydrate ($Al_2O_3.H_2O$) in varying proportions.

Of less satisfactory performance, as admixed with the sand, was hydrous alumina silicate ($Al_2O_3.SiO_2.XH_2O$) (unfired lava), and of still less satisfactory performance, is a slight amount of free water physically admixed with sand, although its physical location within the sand is questionable, and such a fuse is of low interrupting reliability.

9 Claims, 4 Drawing Figures

INVENTOR
James N. Santilli

By
Wilbur R. Grant
ATTORNEY

FUSE STRUCTURE HAVING IMPROVED GRANULAR FILLER MATERIAL

This is a continuation of application Ser. No. 515,949 filed Oct. 18, 1974 now abandoned.

CROSS-REFERENCES TO RELATED APPLICATIONS

Applicant is not aware of any related applications pertinent to the present invention.

BACKGROUND OF THE INVENTION

The present state of the art in making "silver-sand" type current-limiting fuses is to use a silver fuse element surrounded by silicon dioxide sand, as a filler. This type of silver-sand fuse has been very effective in "limiting", or forcing the current to a very low value as soon as the fuse element is melted, or vaporized. This can be seen in oscillograms of typical fuse operations. However, for certain sizes, ratings, currents, etc., current can continue to flow through the fuse, due to the high conductivity of the sand filler after the initial current-limiting action. This can be seen as a "secondary" current-flow on oscillograms of such fuse operations.

Reference may be had to U.S. Pat. No. 3,213,242, issued Oct. 19, 1965 to Frank L. Cameron, and assigned to the assignee of the present invention, for a description of the current-limiting action, which takes place utilizing sand as a filler material. In addition to sand, this U.S. Pat. No. 3,213,242 utilizes a layer of calcium carbonate ($CaCO_3$). The layer of $CaCO_3$ is utilized between the layers of sand in the fuse to obtain specific melting characteristics, and a good low-current clearing ability.

It is, of course, desirable to limit the amount of energy released within the fuse during fuse rupture. Although this is measured by the square of the current, nevertheless the area under the current-time curves give a rough approximation of the energy released within the fuse tube. With fuses of the prior art, utilizing sand only as the filler granular material, I have observed a "secondary" current released very shortly after the main let-through current has ceased. It is, of course, desirable to eliminate the presence of such a "secondary" current, as described hereinbefore with the prior-art types of fuses as it adds to the energy released within the fuse.

SUMMARY OF THE INVENTION

It is, accordingly, a general object of the present invention to provide an improved fuse having an improved granular filler material.

Another object of the present invention is to provide an improved fuse filler material, which has water contained in the filler material, either in a chemically-bonded form, or a physically-bonded form capable of being released during fuse operation.

Still a further object of the present invention is to provide an improved fuse having a mixture of sand and suitable proportions of aluminum trihydrate ($Al_2O_3.3H_2O$).

Another object is to provide a fuse-filler material for use in a fuse structure having varying proportions of the sand and aluminum trihydrate.

In accordance with further embodiments of the invention, aluminum monohydrate ($Al_2O_3.H_2O$) may be used, and of less satisfactory performance, is hydrous alumina silicate ($Al_2O_3.SiO_2.XH_2O$) (unfired lava), or a less reliable fuse, I have found, may be made of ordinary sand admixed with a small amount of added water.

Further objects and advantages will readily become apparent upon reading the following specification, taken in conjunction with the drawings.

DESCRIPTION OF THE PREFERRED EMBODIMENTS

The present state of the art in making "silver-sand" type current-limiting fuses is to utilize one or more silver fuse-elements within an enclosed casing, and surrounded by silicon-dioxide sand as a filler material. This type of fuse has been very effective in "limiting", or forcing the current to a very low value, as soon as the fuse element is melted or vaporized. Current-limiting fuses, as known by those skilled in the art, interrupt high-fault currents before the first loop of fault current has reached its natural crest value. They perform their function by producing arc voltages, which exceed the system voltage by a significant amount, and thereby forcing current zero. The fuse operates in approximately one-half cycle to provide maximum protection to cables, motors, transformers, and other apparatus on the system. The fuse element may be a silver-strap element, which is of pure silver, and combines maximum load-carrying ability with the most favorable short-circuit interruption characteristics. In addition, it is known to have the fuse elements made "fatigue-proof" by prebending the fusible element at regular intervals, resulting in a fuse-link, which is structurally stronger and distributes expansion uniformly. Such fuses may be filled with a high-purity silica sand of controlled grain size. The general interrupting characteristics of such types of fuses are set forth in the following patents: Fahnoe U.S. Pat. No. 2,879,354, issued Mar. 24, 1959, Cameron U.S. Pat. No. 3,069,520, issued Dec. 18, 1962, Cameron U.S. Pat. No. 3,134,874, issued May 26, 1964, Cameron U.S. Pat. No. 3,194,923, issued July 13, 1969, Cameron U.S. Pat. No. 3,213,242, issued Oct. 19, 1965 and Fahnoe U.S. Pat. No. 2,667,549, issued Jan. 26, 1954.

During large overcurrents, the one or more fusible elements may burn through simultaneously at a number of spaced points, causing a number of series arcs, to be formed; and on small overcurrents, the fuse element may burn through at a first point, forming an arc, which thereafter burns back a distance until the current through the fuse falls to zero; and the dielectric recovery strength of the fused sand (fulgurite) becomes adequate to prevent reignition. The ends of the fusible elements are firmly clamped between metallic ferrule members at the ends of the fuse tube.

The fusible element may be formed of any suitable fusible material, such as silver, for example, and may have, for instance, notches spaced axially therealong to provide a current-limiting function. Reference may be had to U.S. Pat. No. 2,496,704, issued Feb. 7, 1950 to H. H. Fahnoe and to U.S. Pat. No. 2,502,992, issued Apr. 4, 1950 to H. L. Rawlings and H. H. Fahnoe for the theory of operation of typical fusible current-limiting elements. Reference may also be made to Cameron U.S. Pat. No. 3,251,968.

Figure 3:
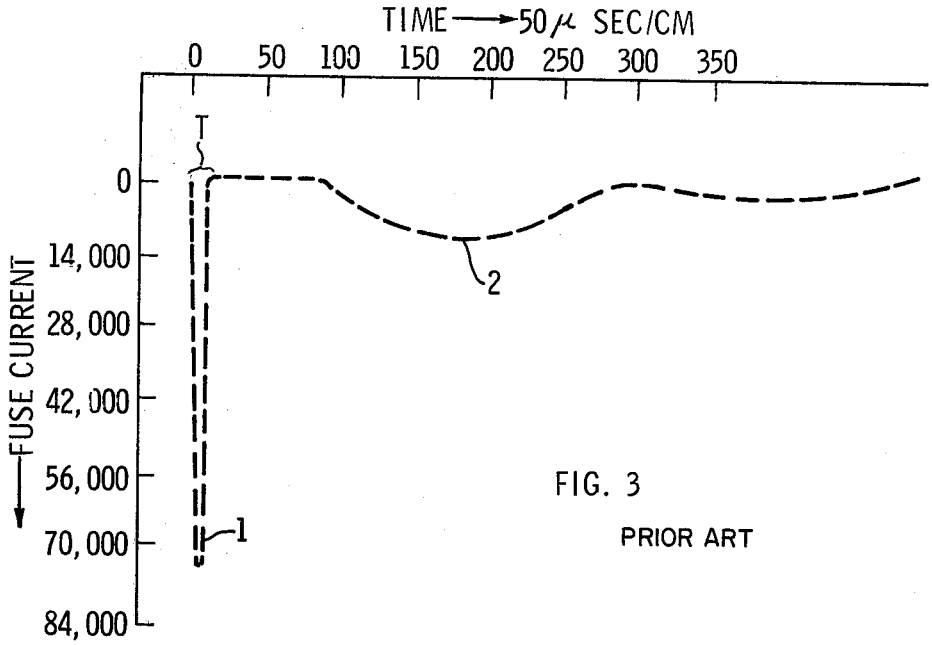
FIG. 3 PRIOR ART
FIG. 3 illustrates an oscillogram of a prior-art fuse, illustrating the "secondary" current, which flows following cessation of the "let-through" current; and, FIG. 4 is a graph of an oscillogram of the clearing characteristics of a fuse utilizing the improved granular filler material of the present invention.

I have discovered that the operation of fuses of the prior art leads to the presence of a "secondary current", as illustrated in oscillograms of fuse operation. Reference may be had to FIG. 3 of the drawings, where the reference numeral 1 indicates the initial "let-through" fuse current, and the reference numeral 2 indicates the "secondary" current, which flows at a later instant of time, as shown. It is, of course, desirable to eliminate the presence of this "secondary" current 2, since the area under such time-current curves gives a rough approximation of the release of energy within the enclosed fuse structure.

In addition, I have discovered that it is desirable to include water, either in a chemically-bonded state within the fuse-filler material, or in a physically-available state, so as to be released during fuse rupture. A theory for the improved performance with the addition of a granular refractory material containing water, is that during fuse blowing, the water must be heated, and its physical state changed, as the temperature rises, which requires large amounts of energy, and results in a lower average fuse temperature during and after current clearing. The contained water also creates localized high pressure, which remains for a period of time until it can flow out into the surrounding granular refractory material 4, and cool. These two factors (lower average fuse temperature and higher localized gas pressure) allow the blown fuse to withstand voltage after clearing with reduced post-clearing currents.

One of the best materials found in the application of this theory, was alumina trihydrate ($Al_2O_3.3H_2O$). Other materials, which were found to work, but not nearly as well, were alumina monohydrate ($Al_2O_3.H_2O$). Of considerably less satisfactory performance, was hydrous alumina silicate ($Al_2O_3.SiO_2.SiO_2.XH_2O$) unfired lava.

Figure 1:
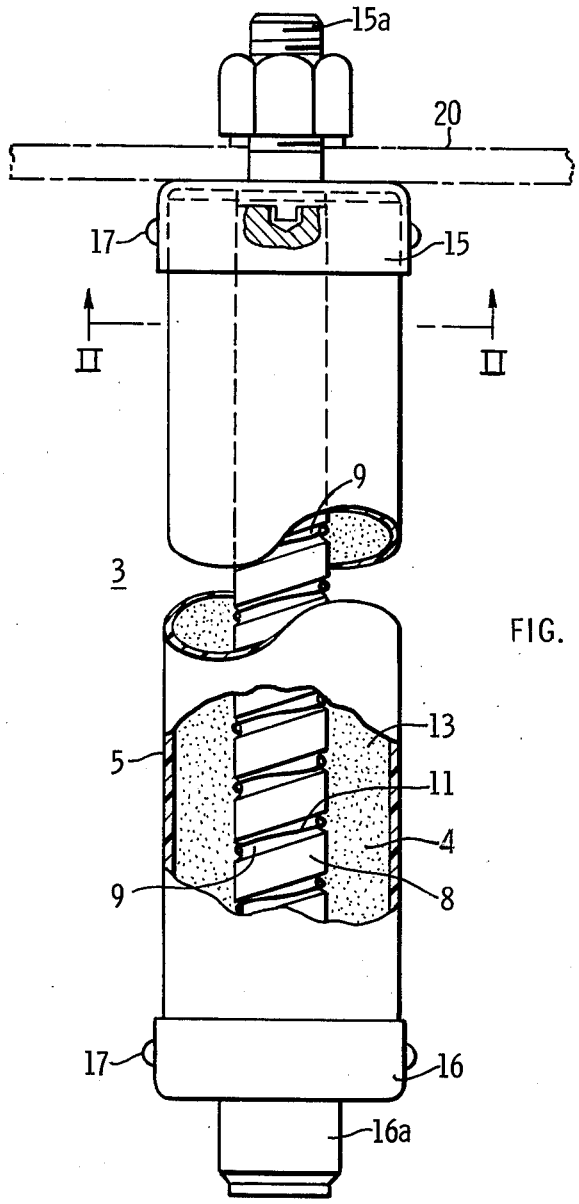
FIG. 1 is a longitudinal part sectional view taken through a fuse structure embodying the improved filler material of the present invention, the fuse being illustrated in its intact unfused condition.

With reference to FIG. 1, it will be observed that there is illustrated an improved fuse device 3 embodying the improved filler material 4 of the present invention. As shown, the fusible device 3 includes an outer casing 5, made of glass-filament-wound epoxy, for example, or other suitable insulating material of the requisite strength, with an interiorly axially-aligned support rod of insulating material, such, for example as steatite. The support-rod 8, has one or more grooves 9 formed helically thereon. Disposed within the grooves 9, formed on the insulating support rod 8, are one or more fusible elements 11, depending upon the current rating of the fuse 3; and within the enclosed volume 13 between the interrupter rod 8 and the outer casing 5, is the improved filler material 4 of the present invention.

Pressed upon the upper and lower ends of the fuse casing 5 are fuse ferrules 15, 16, or fuse terminals, preferably made of copper, or other suitable conducting material. As shown, the fuse wires 11 are electrically connected to the end fuse ferrules, or terminals 15, 16. The ferrules 15, 16 may be cemented to the ends of the insulating casing 5, and secured thereto, as by staking pins 17, for example.

Figure 2:
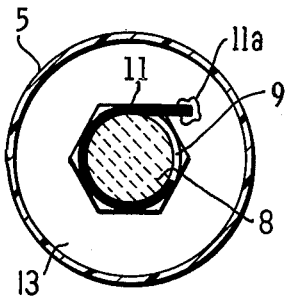
FIG. 2 is a sectional view of the fuse device of FIG. 1, taken along the line II—II of FIG. 1, looking in the direction of the arrows.

FIG. 2 illustrates the fuse wire 11 encircling the interrupter support rod 8 and being attached, or brazed as at 11*a* to an end ferrule or terminal cap 15. As shown, the ferrules 15, 16 may have outwardly-extending terminal-stud portions 15*a*, 16*a* which enables the fusible device 3 to be mounted to a bus 20, or other conductor, as desired.

It is, of course, desirable to control the pressure within the fuse tube 5, and the amount of water released with my improved filler 4 should not be of such a quantity, in the form of steam, as to effect the rupture of the fuse-tube casing 5.

I prefer to use alumina trihydrate, which is well suited for this application, because the material is commercially available from the Aluminum Company of America, Chemical Division, located at 401 North Michigan Ave., Chicago, Ill. 60611, at a reasonable price; and the water is held in a chemically-bonded state, and is not given up at normal operating temperatures, which permits the use of conventional non-moisture sealing materials for the fuse casing 5.

In the higher-current ratings, fuses with large wire diameter, a lower proportion of the aluminum trihydrate is used to prevent rupture of the fuse tube 5. Two pounds of hydrated alumina is mixed with 98 pounds of sand (silicon dioxide) as suitably proportioned by weight. On the other hand, with very low-current-rating fuses 3, all hydrated alumina may be used.

One typical commercial mixture for a 7.5 ampere, 25 KV fuse, with three electrically-parallel silver-fuse wires 11 in the same groove 9 on the interrupter rod 8, each of 0.02 inches diameter, the filling-material proportion was 0.35 pounds of hydrated alumina and 0.65 pounds of sand. In another mixture for one silver fuse wire 11 of 65 ampere rating, on a 5 KV fuse, was 0.10 pounds of hydrated alumina and 0.90 pounds of sand.

Figure 4:
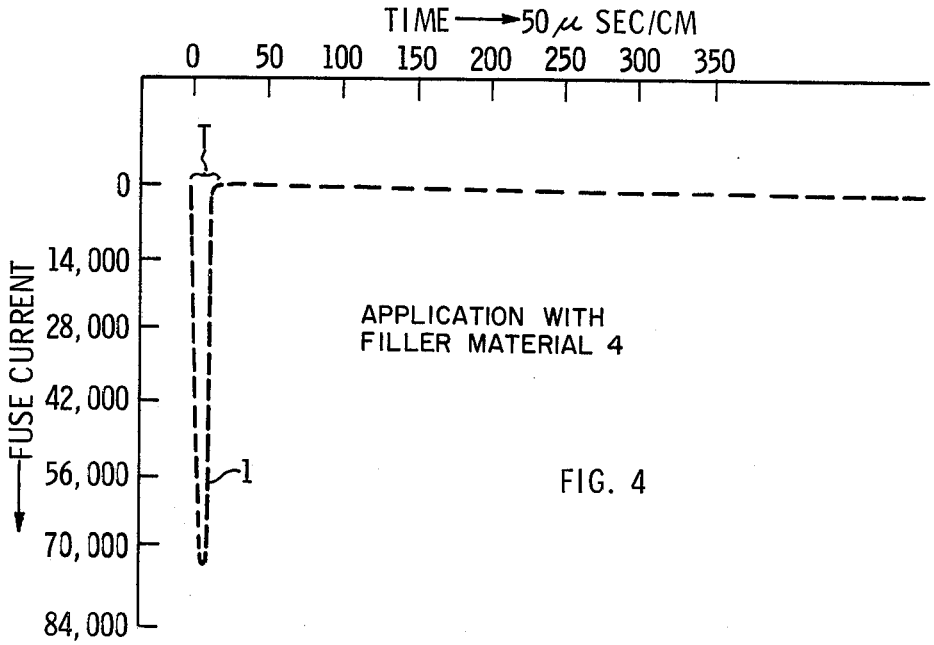

With reference to FIG. 4 of the drawings, it will be observed that a very important result, of using the improved filler material 4 of my invention, is the complete elimination of the "secondary" current 2, which is so pronounced in the FIG. 3 oscillogram graph. As shown in FIG. 4, such a "secondary" current is entirely nonexistent. This, of course, minimizes the energy released within the fuse casing 5, which is very important.

Other materials, which are considerably less desirable than the alumina trihydrate is alumina monohydrate, which has roughly half the interrupting performance of the trihydrate. Other materials, which are considerably less desirable, which I have tested, are unfired lava; and another filler material, with very low reliability is the use of free water alone admixed with sand, although the physical location of the physically-adhered water would be unknown, and such a fuse structure, over a long period of time, would permit an accumulation of water at possibly an undesired location within the fuse casing 5.

From the foregoing description, it will be apparent that I have provided an improved fuse filler material, which is a refractory granular material containing water, to be admixed with the usual sand, or for certain low-rating fuses, may be used alone within the fuse casing 5 to the exclusion of sand, as set forth above.

Although there have been illustrated and described specific structures, it is to be clearly understood that the same were merely for the purpose of illustration and that changes and modifications may be made therein by those skilled in the art, without departing from the spirit and scope of the invention.

I claim as my invention:

1. A fuse structure comprising, in combination, a fuse holder supporting a pair of spaced fuse terminals and defining an enclosed volume, one or more fuse elements electrically connected to said spaced fuse terminals and passing through said enclosed volume, a granular filling material for said enclosed volume to assist in deionizing the arc established during fusing of the fuse structure, said granular filling material comprising sand and admixed water.

2. A fuse structure comprising, in combination, a fuse holder supporting a pair of spaced fuse terminals and defining an enclosed volume, one or more fuse elements electrically connected to said spaced fuse terminals and passing through said enclosed volume, a homogeneous granular refractory filling material for said enclosed volume to assist in deionizing the arc established during fusing of the fuse structure, said homogeneous granular refractory filling material comprising hydrated alumina having contained water, whereby upon fuse rupture the contained water will be released into the material and vaporized, thereby extracting heat and energy from the arc to facilitate arc interruption.

3. A fuse structure comprising, in combination, a fuse holder supporting a pair of spaced fuse terminals and defining an enclosed volume, one or more fuse elements electrically connected to said spaced fuse terminals and passing through said enclosed volume, a granular refractory material for said enclosed volume to assist in deionizing the arc established during fusing of the fuse structure, said granular refractory filling material comprising unfired lava ($Al_2O_3.SiO_2.XH_2O$) having contained water, whereby upon fuse rupture the contained water will be released and vaporized thereby extracting heat and energy from the arc to facilitate arc interruption.

4. A current-limiting fuse comprising a hollow fuse tube having fuse terminals supported adjacent its opposite ends, at least partially a sand filling within said fuse tube, one or more fuse elements passing through the sand within the hollow fuse tube and electrically connected to said spaced fuse terminals, and hydrated alumina homogeneously admixed with said sand to enhance the interrupting performance of the current-limiting fuse.

5. The combination of claim 4, wherein the hydrated alumina constitute 2½% to 50% by weight of the filling material.

6. The combination of claim 4, wherein the hydrated alumina constitutes 33% by weight of the filling material.

7. The combination of claim 4, wherein the hydrated alumina is aluminum trihydrate ($Al_2O_3.3H_2O$).

8. A fuse structure comprising, in combination, a fuse holder supporting a pair of spaced fuse terminals and defining an enclosed volume, one or more fuse elements electrically connected to said spaced fuse terminals and passing through said enclosed volume, a homogeneous granular filling material for said enclosed volume to assist in deionizing the arc established during fusing of the fuse structure, said homogeneous granular filling material comprising sand and an admixed additive of a granular refractory material having contained water, whereby upon fuse rupture the contained water will be released and vaporized, thereby extracting heat and energy from the arc to facilitate arc interruption, and said additive being aluminum trihydrate ($Al_2O_3.3H_2O$).

9. The combination of claim 6, wherein the hydrated alumina is aluminum trihydrate ($Al_2O_3.3H_2O$).

* * * * *